United States Patent [19]

Handa

[11] 4,338,992

[45] Jul. 13, 1982

[54] SEALING STRUCTURE FOR USE IN A ROTARY, HEAT-REGENERATIVE HEAT EXCHANGER

[75] Inventor: Noritoshi Handa, Yokosuka, Japan

[73] Assignee: Nissan Motor Company, Limited, Kanagawa, Japan

[21] Appl. No.: 134,899

[22] Filed: Mar. 28, 1980

[30] Foreign Application Priority Data

Apr. 3, 1979 [JP] Japan ..... 54-39331

[51] Int. Cl.[3] ..... F28D 19/00

[52] U.S. Cl. ..... 165/9; 277/83; 277/81 R

[58] Field of Search ..... 165/9; 277/81 R, 81 S, 277/83, 88–90, 93 R, 93 SD

[56] References Cited

U.S. PATENT DOCUMENTS 3,157,226 11/1964 Atwood ..... 165/9

3,202,207 8/1965 Chute ..... 165/9

*Primary Examiner*—Albert W. Davis

[57] ABSTRACT

A sealing structure for use in a rotary, heat-regenerative heat exchanger includes a seal element with a face in rubbing contact with a regenerator, a first elastic element such as a ring spring coupled to the seal element, and a second elastic element such as a ring spring coupled to a housing. The first and second elastic elements are in contact.

7 Claims, 8 Drawing Figures

SEALING STRUCTURE FOR USE IN A ROTARY, HEAT-REGENERATIVE HEAT EXCHANGER

BACKGROUND OF THE INVENTION

The present invention relates to a sealing structure for use with a rotary heat-regenerative heat exchanger.

FIG. 1 of the accompanying drawings shows the general structure of a prior art rotary regenerative heat exchanger, which may, for example, be utilized in a gas turbine. Reference numeral 1 denotes a housing in which a compressed air passage 2 for conducting compressed air is formed. This compressed air is compressed in a compressor 20, and flows through the passage 2 into a combustor 21, after being heated by the regenerator 4, which is explained in more detail later. Fuel is injected into the stream of compressed air in the combustor 21, and the mixture is ignited. Accordingly, its temperature and pressure rise to high levels. The combustion gases thus produced exhaust, at high speed, temperature, and pressure, through a compressor turbine 22 which rotates the compressor 20, and thence pass to a power turbine 23 to produce output power for external use. From the power turbine 23, these gases pass into the combustion gas passage 3 in the housing 1. After flowing through the regenerator 4, these combustion gases are discharged.

The regenerator 4 is formed as a cylindrical member which crosses over both passages 2 and 3, and which rotates around its central axis while maintaining mutual isolation of these passages 2 and 3. Thereby, heat is transferred from the hot combustion gases flowing through the passage 3 to the cold compressed air flowing through the passage 2, thereby increasing the temperature of the compressed air fed into the combustor 21, thus improving efficiency of the turbine, and also reducing the temperature of the exhausted combustion gases, thereby reducing the difficulty of disposing of them, and reducing thermal pollution of the environment.

In such a turbine, the structure of the regenerator 4 is such that gases can only, substantially, flow through it in its axial direction, and thereby gases are prevented from crossing between the passages 2 and 3, which tends to occur because the gas pressure is generally higher in the passage 2, which contains compressed air, than in the passage 3, which contains exhausted combustion gases. Thus, sealing elements must be provided to prevent transfer of gases between the passages 2 and 3 around the sides of the regenerator 4.

In FIG. 1, such sealing elements are shown as provided between the passage 3 and the regenerator 4. The upstream sealing element 5 is on the hot side of the regenerator 4, and the downstream sealing element 6 is on the cool side of the regenerator 4, in the passage 3.

The details of construction of such a prior art sealing device are shown in FIG. 2. This sealing structure has already been proposed by us for improving upon conventional sealing performance by using the pressure difference between the two passages 2 and 3. In this figure, as in all subsequent figures of this application, the structure shown is a partial section through a sealing device, and it is preferable that this sealing device is circularly symmetrical about the central axis of the circular passage 3, i.e., about an axis approximately shown in FIG. 1 by the arrow pointing downwards in the lower part of passage 3. It is arranged that a toroidal space 9, around the regenerator 4, is communicated with the high pressure compressed air in the passage 2, upstream of the regenerator 4. As explained above, this compressed air is at substantially higher pressure than the gases in the passage 3. Seal elements 5 and 6, supported by seal holders 10, are disposed on the upper and the lower sides of the regenerator 4. On the back of the lower seal holder 10 is attached, by a plurality of bolts 13, a seat member 12 formed of a heat resistant elastic material such as silicon rubber. A pressing plate 14 is fixed to the housing 1, in the location shown, by a spacer 11, a plurality of bolts 16, and a retainer plate 15. The free circular edge of the plate 14 is in pressing contact with a projecting circular ring on the seat member 12. The arrangement described above is circularly symmetric, so that the spacer 11, the pressing plate 14, the retainer plate 15, the seat member 12, the seal elements 5 and 6, the seal holders 10, etc., are all toroidal. A plurality of studs 17 are screwed through the housing 1 to abut against the base portion 12*a* of the seat member 12, so as to compress the seal elements 5 and 6 with a predetermined pressing force, during the assembly of the structure, so as to prevent the pressing plate 14 from damage during this assembly.

According to this structure, the higher gas pressure present in the space 9 presses on the back of the pressing plate 14 and presses it against the seat member 12, so as to compress the two seals 5 and 6 against the regenerator 4 and ensure a good seal. Even after substantial wearing of the seals 5 and 6, this pneumatic pressure ensures that good contact and sealing tends to be maintained. According, thus, to this prior art device, the resilience of the pressing plate 14 is not entirely relied upon for the pressing of the seals 5 and 6 against the regenerator 4.

However, the above described structure is not completely satisfactory. As the seal elements 5 and 6 wear away, much alteration in shape is required from the pressing plate 14, which sometimes cannot cope with the amount of movement required. When this occurs, there is a tendency for a gap to open up between the pressing plate 14 and the seat member 12, especially when the pressure in the space 9 is low, as during starting of the gas turbine. Thereby, poor sealing may occur.

Another problem may occur, in that, because the seat member 12 is made of silicon rubber or the like, its heat resistance is not as good as that of metal.

SUMMARY OF THE INVENTION

Therefore, it is an object of the present invention to provide a sealing structure for a regenerator which has a better sealing performance, even after considerable wear of the sealing elements.

Such a sealing structure can be applied, for example, to a gas turbine for use for automotive vehicles. The sealing structure according to the present invention comprises two elastic members such as ring springs, the outer edge and/or the inner edge of each of these being fixed, respectively, to the housing, and to a seal element.

BRIEF DESCRIPTION OF THE DRAWINGS

The present invention will now be described with reference to several illustrative embodiments thereof, and with reference to the appended drawings, which are all of them, however, given for the purposes of illustration and exemplification only, and are not to be considered as limiting. In these drawings.

DESCRIPTION OF THE PREFERRED EMBODIMENTS

Figure 1:
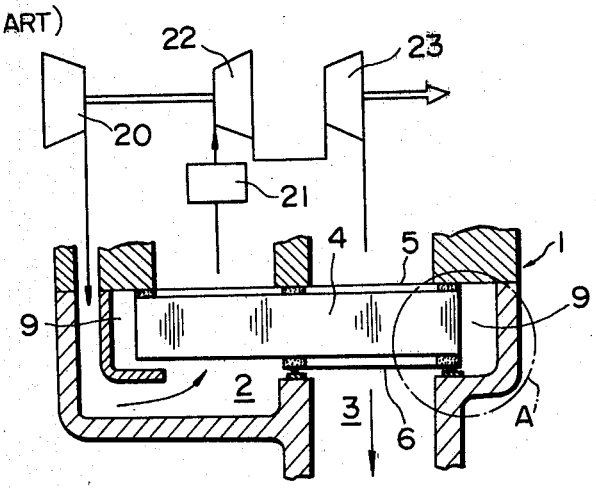
FIG. 1 (PRIOR ART)
FIG. 1 is a schematic sectional view of a prior art structure for a rotary heat regenerative heat exchanger as used in a gas turbine.
Figure 2:
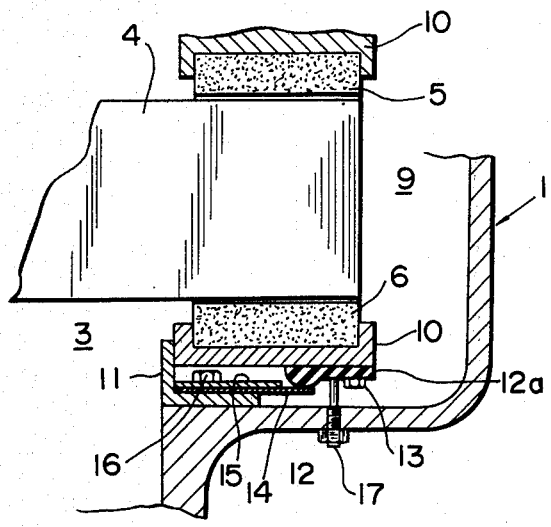
FIG. 2 (PRIOR ART)
FIG. 2 is an enlarged view of part of the sealing structure of the prior art structure of FIG. 1.

Like reference numerals denote like elements in the several embodiments.

Figure 3:
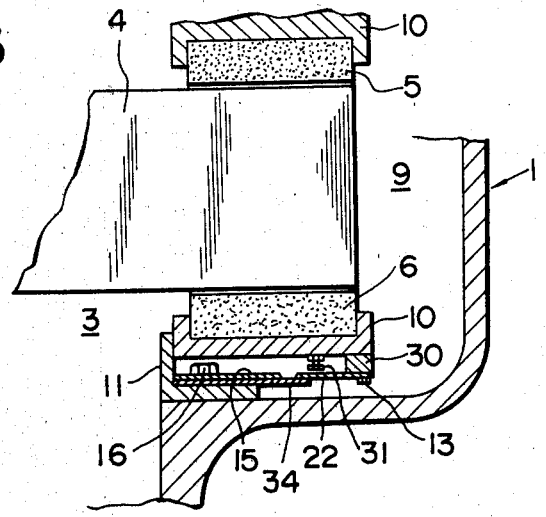
FIGS. 3–8 are sectional views similar to FIG. 2, showing six embodiments of the present invention.

FIG. 3 shows a first embodiment of the present invention. A circular seal holder 10, as in the above explained prior art, is attached to the underside of the cold seal element 6, for example by adhesive. To the outer edge of the underside of the seal holder 10 there is attached the outer edge of a first circular spring member 32, by means of a plurality of bolts 13, via a spacer 30. The inner free circular edge of this spring member 32 is in abutting contact with the outer circular edge of a second circular spring member 34, the inner circular edge of which is fixed to the housing 1 by a plurality of bolts 16, via a spacer 11 and a retainer plate 15. A stopper 31 is provided on the underside of the seal holder 10 so as to restrict the degree of bending of the spring member 32.

As the seal elements 5 and 6 wear away, the ample combined resilience of the two spring elements 32 and 34 ensures that the holder 10 can move upwards in the drawing sufficiently to keep the seals 5 and 6 properly pressed against the regenerator 4, without the effectively gastight seal between the free edges of the spring members 32 and 34 being broken. Thus leakage of compressed air from the space 9 is effectively prevented, even after considerable wear of the seals. As in the prior art, the principal supply of force to press the seal elements 5 and 6 against the regenerator 4 is provided by the pressure of compressed air in the space 9, which acts on the under surfaces in the figure of the springs 32 and 34.

Figure 4:
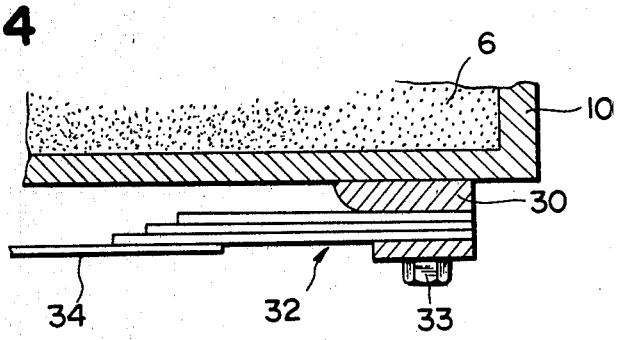

FIG. 4 shows part of a modified embodiment in which the spring member 32 is composed of a plurality of stacked circular springs of different internal diameters. Using this construction, the spring force of this spring 32 may be increased.

Figure 5:
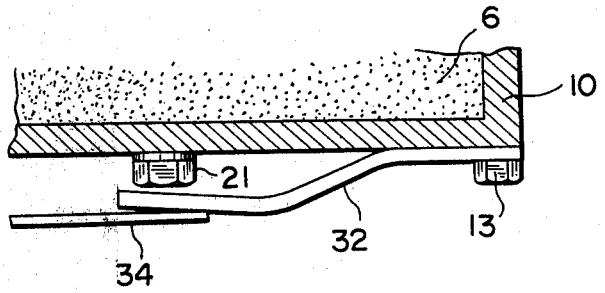

FIG. 5 shows a construction wherein the spring 32 is formed with its inner portions displaced axially from its outer portions. This enables the spacer 30 to be dispensed with.

Figure 6:
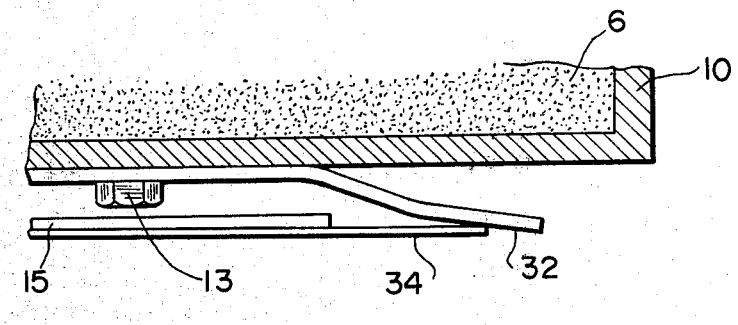

FIG. 6 shows an embodiment in which the configuration of the spring 32 is reversed; that is, its inner edge is fixed to the holder 10, while its outer edge is in contact with the spring 34. In this embodiment the high gas pressure in the space 9 tends to compress the two spring members 32 and 34 together, thus improving sealing performance further.

Figure 7:
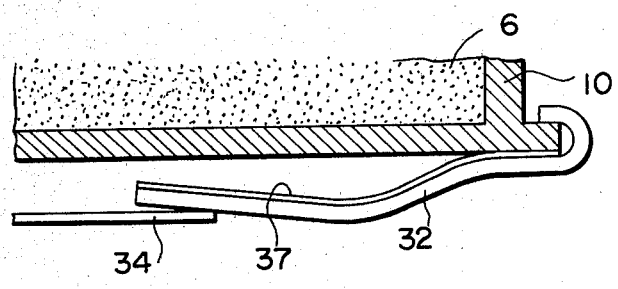

FIG. 7 shows an embodiment generally similar to the FIG. 5 embodiment, but wherein the outer edge of the spring 32 is fixed to the holder 10 by being curled around an outer projecting ring therefrom. Thus, the main body of this spring element 32 is formed of easily workable material. In order to improve the resilience of the assembly, this spring member 32 is backed with a member 37 made of metal such as stainless steel, which has not been heat treated after rolling.

Figure 8:
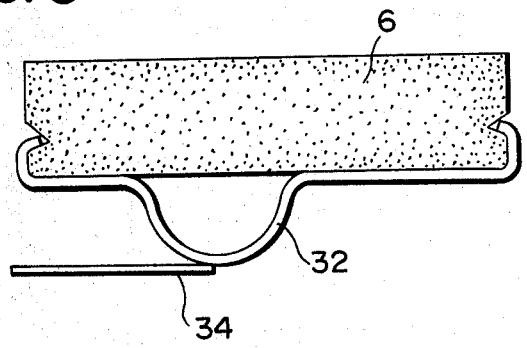

FIG. 8 shows an embodiment in which the spring member 32 is attached directly to the seal 6, without any seal holder 10, at both its inside and outside edges, by curling. Such a structure allows the seal 6 to be reinforced by the spring 32. A circular depression is formed on the intermediate part of the spring 32 for contacting the spring 34. This structure allows the spring 32 to be attached to the seal 6 by a single operation, and, by eliminating the holder 10, reduces production costs.

According to the present invention, by employing two springs instead of one, a greater degree of travel of the spring seal assembly can be obtained. Further, because no material such as silicon rubber need be employed in the construction, heat resistance of the assembly is increased.

Although the present invention has been shown and described in terms of several preferred embodiments thereof, it should not be considered as limited thereto; various changes could be made to the form and the content of any particular embodiment; and it is therefore desired that the scope of protection should be defined solely by the accompanying claims.

What is claimed is:

1. In a rotary heat exchanger comprising a housing and a heat regenerator which is formed as a cylinder rotatable about its axis and which intersects a first and second passage formed in said housing, said passages being adapted to conduct two fluids, the fluid in the first passage being at substantially higher pressure than the fluid in the second passage;

a sealing structure for sealing between the regenerator and an end of the second passage which opposes the regenerator, comprising:

a seal element extending around the periphery of said opposing end, with a face in rubbing contact with the regenerator;

a first elastic member, which has a first joining portion extending around it and coupled to the seal element, and which has a first contact portion extending around it, separated from said first joining portion;

a second elastic member, which has a second joining portion extending around it and coupled to the housing, and which has a second contact portion extending around it, separated from said second joining portion, and in contact with said first contact portion; and the first passage communicating with the space on the other side of the combination of the first and second elastic members from the regenerator, this space being substantially gas-tightly interrupted from communication with the second passage by the contacting of the first and second ring elements at their first and second contact portions, the second elastic member being formed as a substantially flat ring spring, the first elastic member being formed as an assembly of several substantially flat ring springs stacked on one another, the first joining portion including the outer edge of the assembly of the first ring springs, the first contact portion including the inner edge of the assembly of the first ring springs, the second contacting portion including the outer edge of the second ring spring, the second joining portion including the inner edge of the second ring spring.

2. A sealing structure according to claim 1, wherein the first elastic member is made of a plate which has a heat-resisting property.

3. A sealing structure according to claim 1, wherein a spacer is disposed between the seal element and the first elastic member.

4. In a rotary heat exchanger comprising a housing and a heat regenerator which is formed as a cylinder rotatable about its axis and which intersects a first and a second passage formed in said housing, said passages being adapted to conduct two fluids, the fluid in the first passage being at substantially higher pressure than the fluid in the second passage;

a sealing structure for sealing between the regenerator and an end of the second passage which opposes the regenerator, comprising:

a cold side seal element extending around the periphery of said opposing end, with a face in contact with the regenerator;

a circular seal holder attached to the cold side seal element;

a first circular spring member fixed at the outer edge thereof to the seal holder;

a second circular spring member coupled at the inner edge thereof to the housing;

the inner free circular edge of the first circular spring member being in abutting contact with the outer free circular edge of the second circular spring member;

the first passage communicating with the space on the other side of the combination of the first and second spring members from the regenerator.

5. A sealing structure of claim 4, wherein the first circular spring member is composed of a plurality of stacked circular flat springs of different internal diameters.

6. A sealing structure of claim 4, wherein a spacer is disposed between the first circular spring member and the seal holder.

7. A seal structure of claim 4, wherein a spacer is disposed between the second circular spring member and the housing.

* * * * *